United States Patent [19]

von Dewitz

[11] Patent Number: 4,660,751

[45] Date of Patent: Apr. 28, 1987

[54] DEVICE TO SECURE SHOULDER STRAPS OF A RUCKSACK

[76] Inventor: Albrecht von Dewitz, Obereisenbach 85, D 7992 Tettnang, Fed. Rep. of Germany

[21] Appl. No.: 769,007

[22] Filed: Aug. 25, 1985

[30] Foreign Application Priority Data

Aug. 28, 1984 [DE] Fed. Rep. of Germany ... 8425406[U]

[51] Int. Cl.[4] ..... A45F 3/08

[52] U.S. Cl. ..... 224/210; 224/153; 224/261; 224/215

[58] Field of Search ..... 224/153, 209, 210, 211, 224/212, 215, 259, 261, 262

[56] References Cited

U.S. PATENT DOCUMENTS 4,154,381 5/1979 Zuflich ..... 224/262

FOREIGN PATENT DOCUMENTS 648205 7/1937 Fed. Rep. of Germany .

13747 of 1915 United Kingdom ..... 224/210

OTHER PUBLICATIONS

Jim Chase, "Lowe Alpine Systems Specialist Series", *Backpacker,* Jul. 1984, Ziff-Davis Publishing; N.Y., N.Y.

*Primary Examiner*—Stephen Marcus
*Assistant Examiner*—David Voorhees
*Attorney, Agent, or Firm*—McGlew and Tuttle

[57] ABSTRACT

In a device to secure the shoulder straps of a backpack or rucksack, fittings are fitted to the upper ends of the shoulder straps and are pivotally mounted together on a retaining piece. In the preferred embodiment the fittings are situated in the middle of the rucksack and the pivotal mounting of one or both shoulder straps is constructed so as to be continuously adjustable in various angles at the retaining piece. The arrangement permits adjustment of the lateral distance between the shoulder straps in the shoulder region both simply and rapidly to suit the build of the wearer, so that the shoulder straps are always supported in the optimum position.

4 Claims, 2 Drawing Figures

DEVICE TO SECURE SHOULDER STRAPS OF A RUCKSACK

FIELD AND BACKGROUND OF THE INVENTION

This invention relates in general to securing devices and in particular to a new and useful device for securing a shoulder strap of a rucksack to a person's shoulders.

Carrying loaded rucksacks is often very tiring, consequently aids and fittings are used in various configurations to support the sometimes heavy loads favorably. For example, from German Pat. No. 648,205, we know of fastening the upper ends of the shoulder straps of a rucksack on a rigid transverse member which is swivel-mounted on a load bearing member. Although the weight of the rucksack can in this way be born equally on each shoulder during movement of the wearer, it is not adaptable to his build. Moreover, since the width of the transverse members is not variable, the predetermined distance between the shoulder straps does not suit a large proportion of rusksack wearers, the carrying straps thus resting too tightly against the neck on the shoulders or sliding off them.

The aim of the invention is therefore to create a device for securing the upper ends of the shoulder straps of a rucksack or similar, through whose configuration it will be possible to adapt the lateral distance between the shoulder straps in the region of the shoulders simply and rapidly to the build of the wearer so that the shoulder straps are always supported in the optimum position. The complexity of construction should be kept low while ensuring the fastening is always adequate.

According to the invention this is achieved in that the fittings fitted to the upper ends of the shoulder straps are pivotally mounted together on a retaining piece preferably mounted in the center of the rear surface of the rucksack and that the pivotal mounting of one or both shoulder straps on the retaining piece is designed to be of continuously variable adjustment to various angles.

Here it is advantageous to attach the fittings of the shoulder straps by means of two tensioning screws or similar, vertically disposed over one another passing through the fittings to the retaining piece, whereby one of the tensioning screws forms the pivot for the fittings and the fittings may be clamped at various angles by means of the other tensioning screw. In this form it is advantageous for the lower tensioning screw to form the pivot for the fittings and for these fittings to incorporate concentrically disposed to the axis, extended curved slots in which the upper tensioning screw is quided.

In order to render the surface resting against the wearer almost even, it is also advantageous to provide the outer fitting with recesses in its face surface to accomodate the heads of the tensioning screws.

According to a further development, the retaining piece can form a supporting bar extending in the longitudinal axis of the rucksack, in which the tensioning screws may be clamped at various heights.

In this version, the retaining piece is to be provided with a longitudinal extended hole for clamping the tensioning screws and on its reverse side, in the preferred embodiment guided in longitudinal grooves, a sliding tensioning piece into which the tensioning screws passing through the longitudinal extended slot are screwed.

the securing device for rucksack shoulder straps constructed according to the invention is not only simple in its design form and therefore can be produced economically without difficulties, but also by virtue of this, easy operation makes it possible to adjust the lateral distance of the shoulder straps in the region of the shoulder support to the build of the individual wearer.

If the fittings on the upper ends of the shoulder straps are pivotally mounted together on the retaining piece, whereby the pivotal adjusters are constructed so as to have continuously variable adjustment to various angles, it is thus possible to adjust the angle at which the shoulder straps leave the retaining piece to suit the build of the wearer. Moreover, since the pivotal adjusters can also be adjustable for height, optimum adaptation of a rucksack is easily carried out for either slim or well-built, tall or short wearers, without protruding creating points of excessive pressure. In this way the weight of the rucksack is always supported on the optimum part of the shoulders, thus making it possible to avoid the shoulder straps limiting freedom of movement or sliding off.

Accordingly it is an object of the invention to provide an improved device for securing a rucksack to a person's shoulder which includes a retaining piece which is mounted on the rucksack and which has a positioning slot for the pivotal mounting of the fittings of each shoulder strap as well as a curved slot which permits pivoting adjustment of the fittings of each shoulder strap within prescribed limits.

A further object of the invention is to provide a device for mounting a rucksack or backpack to a person's back and which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
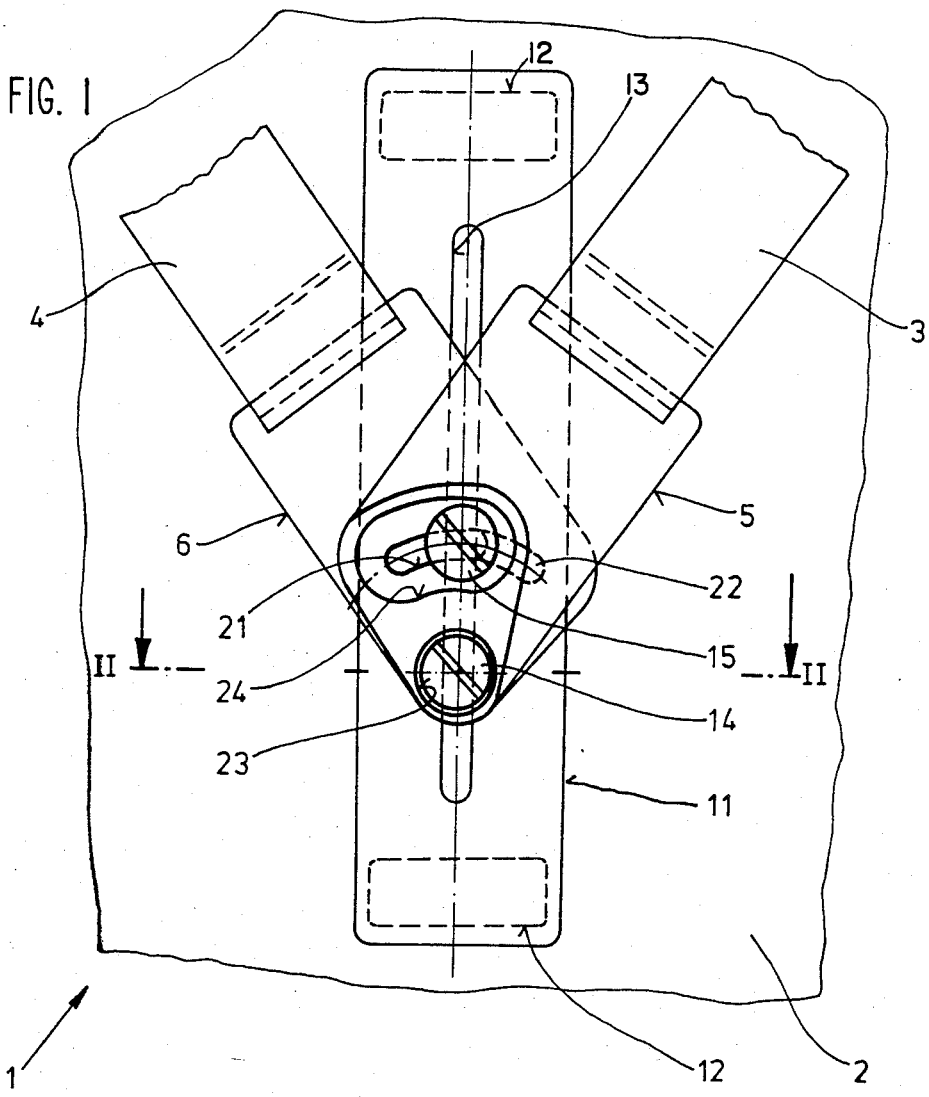
FIG. 1 is a plan view of the shoulder straps mounted adjustably on the rear surface of a rucksack and having an arrangement in accordance with the invention.
Figure 2:
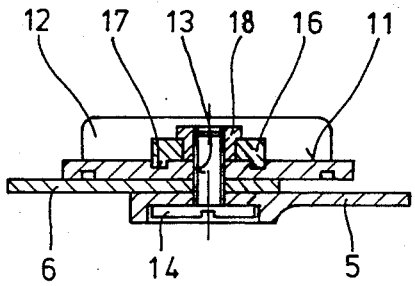
FIG. 2 is a section according to line 2—2 in FIG. 1.

Referring to the drawings in particular the invention embodied therein comprises a device for securing a rucksack to a person's shoulder and it includes a retaining piece 11 which is adapted to be secured to the rucksack and which is mounted on distant pieces or spacers 12, 12. The retaining piece has a vertically extending retaining piece slot 13 and a pair of shoulder straps 3 and 4 positionable on respective sides of the retaining piece 11 and each as a fitting 5 and 6 with a lower portion having aligned bores 23. A pivot bolt for screw 14 engages through the aligned pivot bores and is confined for movement in retaining piece slot 13. Each of the fittings 5 and 6 also have an arcuate slot 21 and 22 spaced from and centered around the pivot bore 23. A tensioning screw 15 engaged through the arcuate slots of each of the fittings 5 and 6 and it may be tightened to adjust the fittings in an adjusted angular position in respect to the retaining piece 11.

On the rear surface 2 of a backpack or rucksack 1, only partly shown in FIG. 1 are fitted two shoulder straps 3 and 4 running approximately vertical. Their sewn-on fittings 5 and 6 are attached adjustably. For this purpose, a retaining piece 11 is fitted a slight distance away from the rucksack rear surface 2 by means of distance pieces 12, fittings 5 and 6 having continuously variable adjustment over a predetermined range of pivoting relative to retaining piece 11.

To permit this, extended holes or curved slots 21 and 22 are incorporated in the fittings 5 and 6, concentrically to a pivot formed by a tensioning or securing screw 14. A further tensioning screw 15 is confined in the respective slots 21 and 22. The tensioning screws 14 and 15 pass through both fittings 5 and 6 and the retaining piece 11 and are screwed into a tensioning piece 16 situated on the reverse side of the piece 11 and it is equipped with threaded bushes 18.

The fittings 5 and 6 can thus be pivoted outwards or inwards, corresponding to the length of the extended holes 21 and 22, so that the lateral distance between the shoulder straps in the region of the shoulders is easy to alter and may be adapted quickly to the build of the individual wearer. The shoulder straps 3 and/or 4 may be set in position by tightening the upper tensioning screw 15 after the fittings 5 and/or 6 are positioned at the desired pivotal setting.

Further to this, in order to allow the pivotal adjusters of shoulder straps 3 and 4 to be adjusted with regard to height also, retaining piece 11 is provided with a longitudinally extended hole or slot 13, through which the tensioning screws 14 and 15 pass. In addition, the tensioning piece is guided in longitudinal grooves 17 in such a manner that it can slide. And since recesses 23 and 24 are incorporated in fitting 5 to accommodate the heads of tensioning screws 14 and 15, a smooth surface to rest against the wearer is created. In this way points of excessive pressure due to protruding parts are avoided.

While a specific embodiment of the invention has been shown and described in detail to illustrate the application of the principles of the invention, it will be understood that the invention may be embodied otherwise without departing from such principles.

What is claimed is:

1. A device for securing a rucksack to a person's shoulders, comprising a retaining piece adapted to be secured to the rucksack having a vertically extending retaining piece slot, a pair of shoulder straps positionable on respective sides of said retaining piece each having a fitting with a lower portion having aligned pivot bores, a pivot bolt engaged through the aligned pivot bores and being confined from movement in the retaining piece slot, each of said fittings also having an arcuate slot spaced from and centered around the pivot bores and a tensioning screw engaged through said arcuate slots and being tightenable to secure the respective fittings in an adjusted angular relationship relative to each other and to said retaining piece.

2. A device according to claim 1, wherein said tensioning screw extends through each of said arcuate slots and into a vertically extending retaining piece slot.

3. A device according to claim 1, wherein the outermost one of said fittings on one side of said tensioning screw is recessed to accomodate the head of said tensioning screw.

4. A device according to claim 1, wherein said retaining piece has a groove thereon on its interior surface facing the rucksack and a tensioning member secured to said tensioning screw and having flange portions engaged in a groove of said retaining piece.

* * * * *